US007971656B2

(12) United States Patent
Engelfried et al.

(10) Patent No.: US 7,971,656 B2
(45) Date of Patent: Jul. 5, 2011

(54) HAND-HELD POWER TOOL WITH A VIBRATION-DAMPED HANDLE WITH A SWITCH

(75) Inventors: Uwe Engelfried, Ostfildern (DE); Gerhard Meixner, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 191 days.

(21) Appl. No.: 12/296,514

(22) PCT Filed: Sep. 7, 2007

(86) PCT No.: PCT/EP2007/059415

§ 371 (c)(1),
(2), (4) Date: Oct. 8, 2008

(87) PCT Pub. No.: WO2008/052832

PCT Pub. Date: May 8, 2008

(65) Prior Publication Data

US 2009/0272553 A1 Nov. 5, 2009

(30) Foreign Application Priority Data

Nov. 3, 2006 (DE) ..... 10 2006 051 924

(51) Int. Cl.
*B25D 17/04* (2006.01)

(52) U.S. Cl. ..... 173/162.2; 173/162.1; 16/111.1

(58) Field of Classification Search ..... 173/162.1, 173/162.2; 16/111.1
See application file for complete search history.

(56) References Cited

U.S. PATENT DOCUMENTS 3,322,211 A * 5/1967 Alabuzhev et al. ..... 173/162.2
3,381,104 A * 4/1968 Abell et al. ..... 200/332.2
4,282,938 A * 8/1981 Minamidate ..... 173/162.2
4,478,293 A 10/1984 Weilenmann et al.
4,749,049 A * 6/1988 Greppmair ..... 173/162.2
5,697,456 A * 12/1997 Radle et al. ..... 173/162.2
5,868,515 A * 2/1999 Janssen ..... 403/97
6,108,916 A * 8/2000 Zeiler et al. ..... 30/391
6,241,594 B1 * 6/2001 Lepold ..... 451/359
6,464,018 B1 * 10/2002 Uhl ..... 173/162.2
6,766,868 B2 * 7/2004 Frauhammer et al. ..... 173/48
6,913,088 B2 * 7/2005 Berger ..... 173/48
7,015,409 B2 * 3/2006 Duffek et al. ..... 200/332.2
7,076,838 B2 7/2006 Meixner
7,100,706 B2 * 9/2006 Meixner et al. ..... 173/162.2
7,320,369 B2 * 1/2008 Stirm et al. ..... 173/162.2
7,500,527 B2 * 3/2009 Fischer et al. ..... 173/162.2
7,523,790 B2 * 4/2009 Arakawa et al. ..... 173/162.2
7,591,325 B2 * 9/2009 Robieu ..... 173/162.2

(Continued)

FOREIGN PATENT DOCUMENTS

DE 1 260 399 2/1968

(Continued)

*Primary Examiner* — Rinaldi I Rada
*Assistant Examiner* — Gloria R Weeks
(74) *Attorney, Agent, or Firm* — Michael J. Striker

(57) ABSTRACT

A hand-held power tool, has a housing, at least one partially hollow U-shaped C-shaped handle with a yoke part and two parallel leg parts and supported in a resilient manner such that the handle is movable relative to the housing in order to dampen vibrations, at least one coupling element accommodated at least partially inside the C-shaped handle to synchronize motion between the two leg parts and having a recess, and a switch arranged in a vicinity of the coupling element and having a switch housing extending in an interior of the handle and accommodated in the recess of the coupling element.

11 Claims, 2 Drawing Sheets

U.S. PATENT DOCUMENTS

| | | | | |
|---|---|---|---|---|
| 7,610,967 | B2 * | 11/2009 | Fischer et al. | 173/162.2 |
| 2003/0132016 | A1 * | 7/2003 | Meixner et al. | 173/162.2 |
| 2006/0185867 | A1 * | 8/2006 | Frauhammer et al. | 173/162.1 |
| 2006/0254785 | A1 * | 11/2006 | Watanabe | 173/48 |
| 2008/0000664 | A1 * | 1/2008 | Steinke | 173/162.2 |
| 2008/0283261 | A1 * | 11/2008 | Schmid et al. | 173/162.2 |
| 2009/0025950 | A1 * | 1/2009 | Steinke et al. | 173/162.2 |
| 2009/0236112 | A1 * | 9/2009 | Hahn | 173/162.2 |
| 2009/0272553 | A1 * | 11/2009 | Engelfried et al. | 173/162.2 |
| 2010/0012339 | A1 * | 1/2010 | Hahn et al. | 173/162.2 |
| 2010/0025062 | A1 * | 2/2010 | Engelfried et al. | 173/162.2 |

FOREIGN PATENT DOCUMENTS

| | | |
|---|---|---|
| DE | 31 22 979 | 1/1983 |
| DE | 101 38 123 | 2/2003 |
| EP | 1 529 603 | 5/2005 |
| WO | 03/011532 | 2/2003 |
| WO | 2007/115845 | 10/2007 |
| WO | 2007/128634 | 11/2007 |

* cited by examiner

Fig. 2
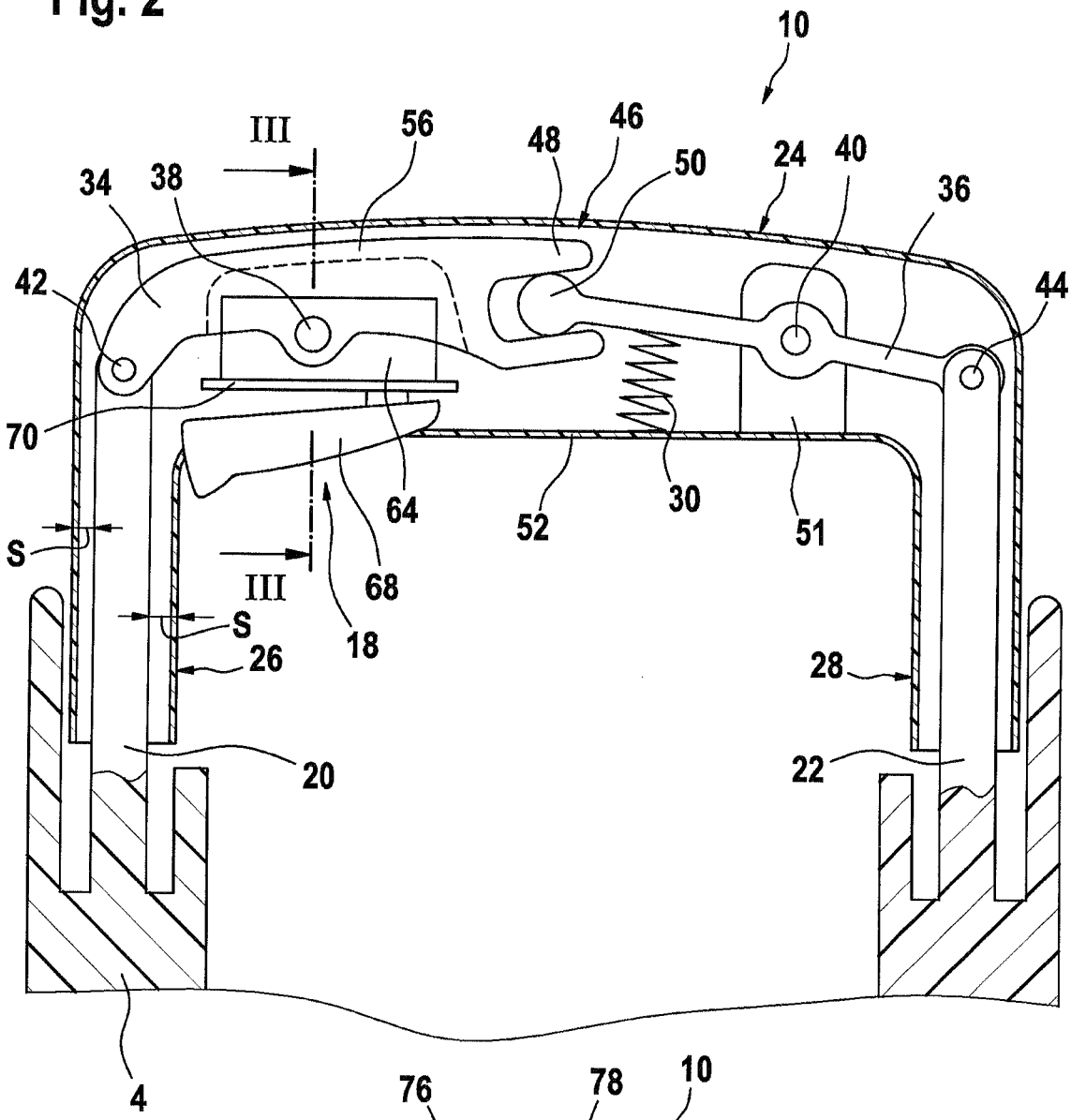
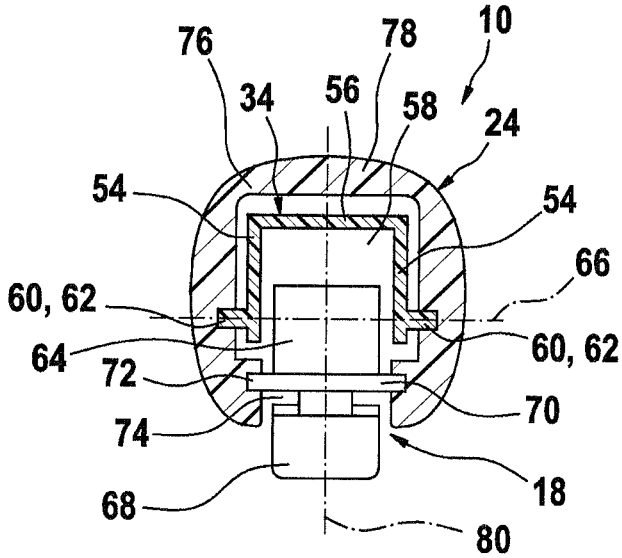
Fig. 3

HAND-HELD POWER TOOL WITH A VIBRATION-DAMPED HANDLE WITH A SWITCH

CROSS-REFERENCE TO RELATED APPLICATION

The invention described and claimed hereinbelow is also described in German Patent Application DE 10 2006 051 924.8 filed on Nov. 3, 2006. This German Patent Application, whose subject matter is incorporated here by reference, provides the basis for a claim of priority of invention under 35 U.S.C. 119(a)-(d).

BACKGROUND OF THE INVENTION

The present invention relates to a hand-held power tool, in particular a rotary hammer and/or a percussion hammer, with a housing and a vibration-damped, U-shaped handle that is resiliently supported and is movable relative to the housing.

With hand-held power tools with an impact drive in particular, such as rotary hammers, chisel hammers, and the like, the hand-held power tool may be subjected to considerable vibrations. When these vibrations are transferred to a handle that is used to press the hand-held power tool against a work piece, the operator perceives the vibrations to be uncomfortable, and long-term exposure thereto may even result in injury. For this reason, double-shelled housings, with which the entire hammer is suspended in an outer shell such that it is resilient in its working direction, have usually been used to provide linear vibration damping of rotary hammers. This design is relatively complex and expensive, however.

Publication EP 1 529 603 makes known a hand-held power tool that includes a vibration-damped C-shaped handle that is supported against the housing via springs. With this hand-held power tool, extensions of two leg parts of the C-shaped handle extend into a cavity in the housing, where they act via connecting elements on swivel arms, the motion of which is damped via springs. To synchronize the motion of the swivel arms and, therefore, the two leg parts, the two swivel arms are connected via a coupling element designed as an axle. A switch for switching the hand-held power tool on and off is located inside the hollow handle.

Publication DE 101 38 123 A1 makes known a hand-held power tool of the type described initially with a vibration-damped C-shaped handle, with which one of the leg parts is supported against the housing via a spring, and with which the motion of the two leg parts is synchronized via two coupling elements, which are hingedly connected with the handle and the housing, one of which is accommodated in the interior of the hollow yoke part in a space-saving manner.

In addition, a hand-held power tool of the type described initially was proposed in the two unpublished German patent applications that belong to this applicant, with which two coupling elements are located inside the yoke part of a hollow C-shaped handle.

By accommodating one or more coupling elements in the interior of the hollow C-shaped handle, the amount of space required inside the housing of the hand-held power tool and, therefore, their overall length, may be reduced, which, in turn, enables the amount of force required to handle the hand-held power tool to be reduced. Previously, however, a design of this type was only possible with those hand-held power tools with which a switch was not provided on the C-shaped handle, since the space available inside of it was not sufficient to accommodate an inwardly extending housing of the switch or one or more coupling elements.

SUMMARY OF THE INVENTION

The object of the present invention, therefore, is to find a solution that makes it possible to equip the C-shaped handle of hand-held power tools of the type described initially with a switch without impairing the function of a coupling element located in the region of the switch.

In the present invention the coupling element is provided with a recess in the vicinity of the switch, into which a switch housing of the switch may extend into the interior of the C-shaped handle, and therefore the switch may be installed on the handle using simple means and without hindering the function of the coupling element.

According to a preferred embodiment of the present invention, the coupling element is designed as a hollow profile open on the side, along a portion of its length, while the rest of the coupling element may be designed as a solid component or as a hollow profile that is closed on all sides, in order to provide the coupling element with great bending resistance.

The coupling element is preferably designed as a rectangular box profile along at least a portion of its length, the opposite side walls of which are advantageously parallel with each other and are oriented toward adjacent outer sides of the switch housing, while the base of the box profile is located on the side of the coupling element facing away from the switch housing. In this manner, the switch housing may extend far into the coupling element, which has strong bending resistance despite its longitudinal extension, therefore allowing considerable contact forces to be transmitted from the C-shaped handle into the housing of the hand-held power tool.

According to a further advantageous embodiment of the present invention, the switch is located in the vicinity of a pivot joint of the coupling element, where it bears inside the handle and receives additional reinforcement due to the support, and where the path of travel of the coupling element during a motion of the C-shaped handle relative to the hand-held power tool is at a minimum, thereby enabling the penetration depth of the switch housing into the recess and, therefore, the depth of the recess, to be reduced.

To provide good support of the coupling element in the rocker pivot, the coupling element advantageously includes two flush pivot pins that are coaxial with the pivot axis of the rocker pivot, which extend beyond the opposite side walls of the box profile and into opposite bearing openings in the C-shaped handle.

The switch is preferably inserted into an opening in a front boundary wall of the C-shaped handle facing the housing of the machine tool, and includes an actuating element that extends beyond the yoke part of the C-shaped handle and is swivelable against the force of a spring relative to the switch housing, the actuating element extending into a grip opening between the C-shaped handle and the housing.

BRIEF DESCRIPTION OF THE DRAWING

The present invention is described in greater detail below with reference to an exemplary embodiment shown in the drawing.

FIG. 2 shows a partially cut-away, enlarged side view of a rear grip region of the hand-held power tool in FIG. 1, with no force applied to the handle;

FIG. 3 shows an enlarged sectional view along the line III-III in FIG. 2.

DESCRIPTION OF THE PREFERRED EMBODIMENTS

Figure 1:
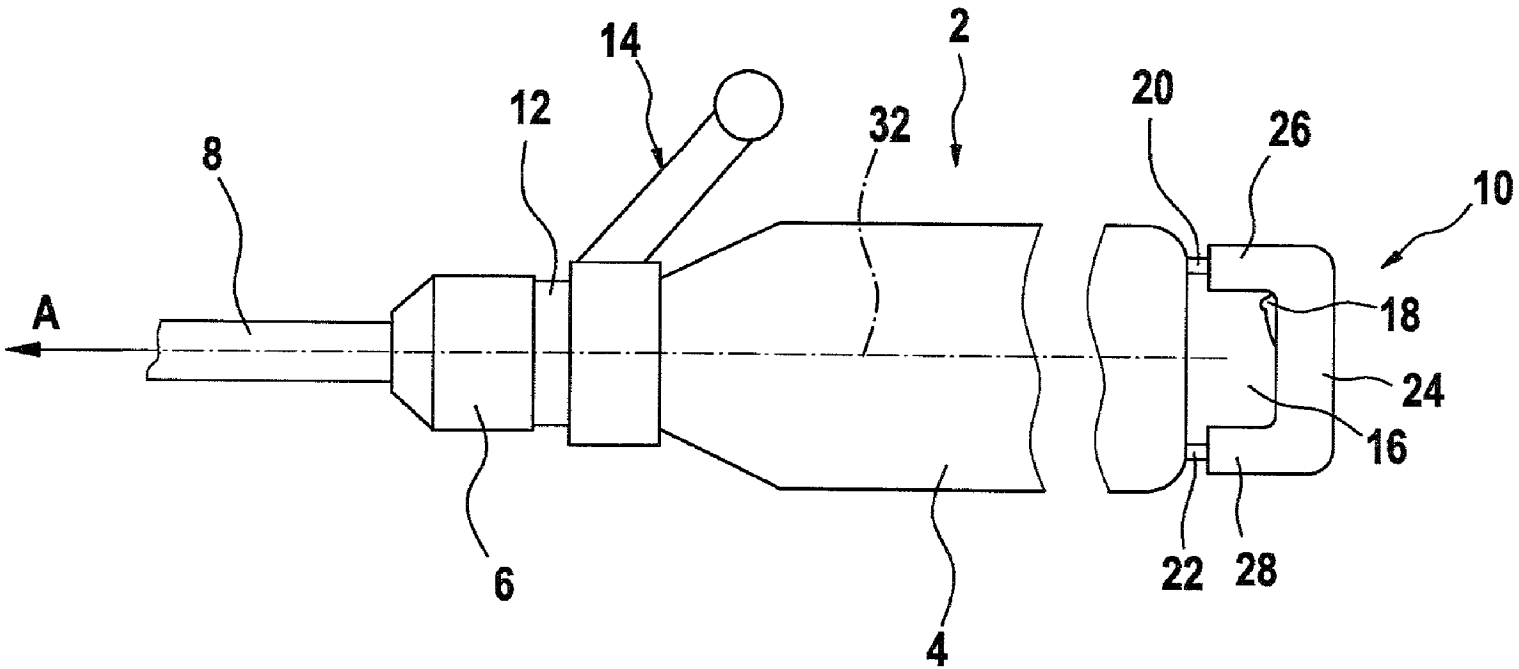
FIG. 1 shows a simplified, schematic side view of a hand-held power tool.

Hand-held power tool 2, which is depicted schematically in FIG. 1 and is designed as a rotary hammer or a percussion hammer, is essentially composed of a housing 4, a tool holder 6 for accommodating a tool 8, and a drive device (not shown) enclosed by housing 4 that drives tool 8 installed in tool holder 6 in a rotating and percussive manner.

The drive device is composed—in a known manner—of an electric drive motor that drives tool holder 6 in a rotating manner via reduction gears and a transmission, and an impact mechanism that is also driven by the drive motor, and with which tool 8 in tool holder 6 may be acted upon with an impact force that acts in a working direction A of machine tool 2.

Housing 4 is provided with a C-shaped handle 10 on its end face that faces away from tool holder 6. C-shaped handle 10 is used—together with an auxiliary handle 14 that is detachably installed near tool holder 6 or 12—to grip and hold machine tool 2. Together with housing 4, C-shaped handle 10 encloses a grip opening 16 for a hand of an operator and makes it easier for him to hold and guide machine tool 2, particularly during vertical operation, i.e., in vertical working direction A and with tool 8 oriented downward, while auxiliary handle 14 is used preferably when working direction A is oriented horizontally or flat.

C-shaped handle 10 is provided with a switch 18 on its side facing grip opening 16, with which hand-held power tool 2 may be switched on and off without releasing handle 10.

As shown best in FIG. 2, housing 4 includes two parallel projections 20, 22, which project rearwardly beyond the rear end face of housing 4, are rigidly connected with housing 4, and extend into the hollow interior of C-shaped handle 10.

C-shaped handle 10 is essentially composed of a hollow yoke 24 that extends perpendicularly to working direction A of hand-held power tool 2 and is gripped with one hand by the operator in order to use hand-held power tool 2. C-shaped handle 10 is also composed of two hollow legs 26, 28 that extend parallel to working direction A and are open at their end faces adjacent to housing 4, thereby enabling projections 20, 22 of housing 4 to enter legs 26, 28.

To prevent the vibrations—caused, e.g., by the impact mechanism of machine tool 4—of housing 4 from being transferred to C-shaped handle 10—the vibrations not only being perceived as uncomfortable by the operator but also possibly resulting in injury after long-term exposure—the two legs 20, 22 of housing 4 extend into hollow legs 26, 28 of C-shaped handle 10 with a great deal of lateral play S. In addition, C-shaped handle 10 does not bear directly against projections 20, 22 or housing 4, but rather via a helical compression spring 30, which serves to decouple vibrations between C-shaped handle 10 and housing 4.

To prevent C-shaped handle 10—which has been decoupled from housing 4 in this manner—from tilting while work is performed with the hand-held power tool in working direction A and a compressive force is applied to C-shaped handle 10—this compressive force being introduced such that it is not entirely parallel to working direction A, or it is applied to C-shaped handle 10 on one side of a longitudinal central plane 32 (FIG. 1) of hand-held power tool 2—the motions of the two hollow legs 26, 28 along projections 20, 22 are synchronized with the aid of two coupling rods 34, 36.

The two longitudinal coupling rods 34, 36 are accommodated in the hollow interior of yoke 24 of C-shaped handle 10 and are generally oriented transversely to working direction A and longitudinal central plane 32 of hand-held power tool 2. Each of the two coupling elements 34, 36 is designed as a two-armed lever that is supported near its center in a pivot joint 38 or 40, so that it may swivel relative to C-shaped handle 10. The end face of each coupling element 34, 36 that points outwardly away from longitudinal central plane 32 is hingedly connected via a pivot joint 42 and 44 to the free end of adjacent projection 20 and 22, while the opposite, inner end faces of coupling elements 34, 36 form a knuckle joint 46. To form knuckle joint 46, the end face of one coupling element 34 is designed as a fork 48, into which a spherical wide section 50 on the end face of the other coupling element 36 engages in a movable manner. Knuckle joint 46 enables the two coupling elements 34, 36 to be displaced longitudinally to a certain extent relative to each other when they are swiveled around the swivel axes of pivot joints 38 and 40 when relative motion takes place between C-shaped handle 10 and housing 4.

While coupling element 36 is designed as a solid coupling rod, which is provided with a wide section on its inner end face, as well as in the center and on the outer end face, in order to form pivot joints 40, 44, coupling element 34 is designed—on a portion of its length between its outer end face that is hingedly connected to projection 20 and its inner, forked end face—as a hollow box profile that is open on one side and includes two parallel side walls 54 and a perpendicular base 56, as shown in FIG. 3. In addition, pivot joint 40 includes a projection 51—which extends into the hollow interior of C-shaped handle 10—of a front boundary wall 52 of yoke 24 that faces housing 4, while pivot joint 38 of coupling element 34 includes two opposing, flush, cylindrical bearing openings 62 in opposite boundary wall parts of C-shaped handle 10, and two pivot pins 60 that extend outwardly beyond side walls 54 and extend into bearing openings 62.

The two side walls 54 and base 56 border a recess 58, which has a rectangular cross section and is open toward front boundary wall 52 of yoke 24, and which accommodates switch housing 64 of switch 18—which extends inwardly beyond boundary wall 52—in a manner such that the swivel motion of coupling element 34 is not hindered by switch 18. To this end, recess 58 extends away from pivot joint 38—whose swivel axis 66 passes through switch housing 64—toward both sides and beyond the opposite end faces of switch housing 64.

To attach switch 18 to C-shaped handle 10 in such a manner that its switch housing 64 extends into the hollow interior of yoke 24 and/or into recess 58 of coupling element 34, and an actuating element 68 of switch 18 that may be tilted or swiveled relative to switch housing 64 extends outwardly past boundary wall 52 and into grip opening 16, switch housing 64 including—on its side adjacent to actuating element 68—a cover plate 70, the outer edge of which extends beyond the lateral sides and end faces of housing 64 and, when switch 18 is installed in C-shaped handle 10, is inserted into a complementary recess 72 formed in an edge of an opening 74 in boundary wall 52 that serves to accommodate switch 18.

To enable coupling elements 34, 36 and switch 18 to be installed in C-shaped handle 10, C-shaped handle 10 is composed of two mirror-image half shells 76, 78, which are joined after coupling elements 34, 36 and switch 18 are installed in one of the two half shells 76, 78, which are then welded together along a central plane 80 of C-shaped handle 10, as shown in FIG. 3.

The present invention may also be used in an analogous manner with a hand-held power tool whose C-shaped handle includes a coupling element that extends into the handle only partially, as does the C-shaped handle of the hand-held power tool described in DE 101 38 123 A1.

What is claimed is:

1. A hand-held power tool, comprising a housing; at least one partially hollow C-shaped handle having a yoke part and two parallel leg parts and supported in a resilient manner such that the handle is movable relative to the housing in order to dampen vibrations; at least one coupling element accommodated at least partially inside the C-shaped handle and synchronizing motion between the two leg parts, said coupling element having a recess; and a switch arranged in a vicinity of the coupling element and having a switch housing extending in an interior of the handle and accommodated in the recess of the coupling element, wherein the housing has two projections extending into the two leg parts of the handle, said coupling element has two coupling rods having two opposite outer end faces hingedly connected with said projections and also two inner end faces facing one another and forming together a knuckle joint allowing a displacement of said coupling rods relative to one another, said recess in which said housing of said switch element is accommodated is provided in one of said coupling rods.

2. The hand-held power tool as recited in claim 1, wherein the coupling element is a hollow profile that is open on a side, across at least a portion of its length.

3. The hand-held power tool as recited in claim 1, wherein the coupling element is a rectangular box profile across at least a portion of its length.

4. The hand-held power tool as recited in claim 3, wherein opposite sides of the switch housing are oriented parallel with each other and parallel to two opposite side walls of the box profile.

5. The hand-held power tool as recited in claim 1, wherein the switch is located in a vicinity of a pivot joint of the coupling element.

6. The hand-held power tool as recited in claim 1, wherein the switch is inserted into an opening of a boundary wall of the C-shaped handle.

7. The hand-held power tool as recited in claim 6, wherein the switch is inserted into an opening in a front boundary wall of the C-shaped handle that faces the housing of the machine tool.

8. The hand-held power tool as recited in claim 7, wherein an actuating element of the switch extends into a grip opening bounded by the C-shaped handle and the housing of the machine tool (2).

9. The hand-held power tool as recited in claim 5, wherein the pivot joint includes two flush cylindrical bearing openings in boundary wall parts of the C-shaped handle and two pivot pins that extend beyond the coupling element toward opposite sides and engage in the bearing openings.

10. The power tool as recited in claim 5, wherein the pivot joint (38) has a pivot axis (66) that passes through the switch housing (64).

11. The hand-held power tool as recited in claim 1, wherein each of said coupling rods is pivotable about a pivot point, so that the switch housing of the switch does not hinder a swivel motion of the coupling element.

* * * * *